US005890731A

United States Patent [19]

Challande et al.

[11] Patent Number: 5,890,731

[45] Date of Patent: Apr. 6, 1999

[54] SKI BINDING ASSEMBLY

[75] Inventors: Christian Challande, Cruseilles; Pierre Desarmaux, Evires; Pascal Thomas, Chambery, all of France

[73] Assignee: Salomon S.A., Metz-Tessy, France

[21] Appl. No.: 857,542

[22] Filed: May 16, 1997

Related U.S. Application Data

[63] Continuation of Ser. No. 339,188, Nov. 10, 1994, abandoned.

[30] Foreign Application Priority Data

Nov. 10, 1993 [FR] France ..... 93 13677

[51] Int. Cl.[6] ..... A63C 9/085

[52] U.S. Cl. ..... 280/625; 280/628; 280/636

[58] Field of Search ..... 280/623, 625, 280/626, 628, 636, 634, 613

[56] References Cited

U.S. PATENT DOCUMENTS

| | | | |
|---|---|---|---|
| 4,294,460 | 10/1981 | Kirsch | 280/607 |
| 4,538,828 | 9/1985 | Dimier | 280/628 |
| 4,902,031 | 2/1990 | Bogner | 280/636 X |
| 4,984,816 | 1/1991 | Rullier | 280/625 |
| 5,558,356 | 9/1996 | Challande et al. | 280/625 |
| 5,560,634 | 10/1996 | Challande et al. | 280/634 |
| 5,566,968 | 10/1996 | Challande et al. | 280/634 |

FOREIGN PATENT DOCUMENTS

| | | | |
|---|---|---|---|
| 306597 | 4/1973 | Austria . | |
| 0102868 | 3/1984 | European Pat. Off. . | |
| 2523857 | 9/1983 | France . | |
| 2624386 | 6/1989 | France . | |
| 2656807 | 7/1991 | France | A63C 9/08 |
| 2255406 | 5/1974 | Germany . | |
| 2832121 | 1/1980 | Germany . | |
| 2905837 | 8/1980 | Germany . | |
| 3335878 | 4/1984 | Germany . | |
| WO 91/09654 | 7/1991 | WIPO | A63C 5/075 |

*Primary Examiner*—Brian L. Johnson
*Assistant Examiner*—Michael Mar
*Attorney, Agent, or Firm*—Greenblum & Bernstein, P.L.C.

[57] ABSTRACT

A binding element adapted to retain the end of a boot. It includes a body that bears on a jaw. The jaw is vertically movable, and its movement is transmitted to the return spring of the jaw, which constitutes a compensation for a backward fall. The sole of the boot is pinched between a support plate and sole-tightener of the jaw. The support plate is movably mounted about a horizontal and longitudinal axis so that a twisting of the boot causes an elevation of the jaw and thus, activates the compensation mechanism.

18 Claims, 9 Drawing Sheets

121
125
140
129
128
120
127
124
141
146
145

125
135
130
128
122
132
141
145
146
129
123
136
134
133
131
140

SKI BINDING ASSEMBLY

This application is a continuation of application Ser. No. 08/339,188, filed Nov. 10, 1994, now abandoned.

FIELD OF THE INVENTION

The invention is related to an alpine ski binding element intended to retain a boot in support on a ski, and to release it in case of excessive bias.

DESCRIPTION OF BACKGROUND AND OTHER INFORMATION

It is known that a boot can be retained in support on a ski by means of a front binding element and a rear binding element. Each retention element has a jaw that is borne by a body, which is movable against the return force exerted by an energizing spring, generally a compression spring.

The invention is more specifically related to a front binding element. Usually, the front binding element reacts to a lateral stress from the front end of the boot. Such a bias is a result of a pure torsional bias on the skier's leg. When the fall is complex, such an element reacts to the lateral component of the bias exerted by the boot.

In order to take into account the other bias components, especially the upward or downward vertical components, the binding elements are equipped, in addition, with compensation mechanisms. Thus, some binding elements react to an upward vertical bias. This type of bias means that the skier falls towards the back. European Patent Application No. 102,868 describes such a binding, for example.

Other bindings have a compensation mechanism that reacts in case of a torsional bias combined with a frontward fall of the skier. Such a mechanism is described, for example, in German Patent Application No. 2,905,837. Such a mechanism comprises a vertically movable support plate for the boot, whose movement caused by a downward vertical pressure of the boot reduces the return force that the spring exerts on the jaw.

Another mechanism is described in German Patent Application No. 3,335,878. This mechanism also comprises a support plate for the boot that is vertically movable and that forces the jaw to become displaced in the direction of the release of the boot.

Such devices compensate the increased friction of the boot on its supports that is induced by the frontward component of the fall. Such mechanisms are satisfactory as long as the lateral component of the fall remains preponderant with respect to the vertical component.

However, it is to be noted that in some so-called "pre-torsion" falls, i.e, having a frontward component as well as a lateral component, the lateral component is not enough to cause the lateral pivoting of the jaw. This results in the boot becoming twisted and stuck between the jaw and its support plate. Currently known compensation mechanisms are not active enough to cause the jaw to open. This results in dangerous falls and cause injuries, especially near the skier's knees.

SUMMARY OF THE INVENTION

One object of the invention is to propose a binding element that releases the boot, especially in case of a pre-torsion fall where the lateral component is relatively weak.

Another object of the invention is to propose a binding element that is relatively simple to build.

Other objects and advantages of the invention will become apparent from the description that follows, such description being provided only as a non-limiting example.

The alpine ski binding element as per the invention includes:

- a base connected to the ski,
- a body mounted on the base,
- a jaw for retention of the boot borne at least partially in a horizontal plane by the movable body,
- the jaw includes two lateral retention wings for the boot and a sole-tightener for vertical retention,
- at least each of the lateral retention wings are movable in a horizontal plane in response to the biases of the boot, against the force developed by a return spring housed in the body,
- at least the sole-tightener of the jaw is vertically movable in response to the upward vertical biases,
- a compensation mechanism connects the sole-tightener to a return spring of the wings, so as to reduce the force exerted by the spring on the wings after an upward vertical bias exerted on the sole-tightener,
- a support element on which the end of the sole of the boot rests in the vicinity of the jaw.

The support element of the invention forms for the boot a longitudinally oriented pivot axis located in the median portion of the sole, and that the vertical distance between the support element and the sole-tightener is substantially equal to the thickness of the sole of the boot, such that any twisting of the boot in the binding element is translated by the boot pivoting about the support element, and that the edge of the sole that rises vertically biases the sole-tightener upwardly.

Due to this characteristic, the boot rests downwardly against the retention element, and in case of a rolling bias causing the boot to become twisted, the boot pivots about the support element. The rising sole portion upwardly biases the sole-tightener, which activates the compensation mechanism provided for backward falls.

The joining of a central support element or a movable rolling support plate and a binding element equipped with a backward fall compensation mechanism enables such compensation mechanism to be activated not only in case of a backward fall, but also in cases where the boot tends to become twisted in its binding element during a pre-torsion fall.

According to another, secondary aspect of the invention, the support plate is itself connected to second compensation means that transmit the rolling biases from the support plate to the return spring. Such biases exert a compensation force on the spring that is added to the force generated by the sole-tightener.

According to another feature of the invention, one element among the base, body or jaw is disengageable with respect to the element that bears it or on which it is mounted, and a control circuit activates the disengagement beyond a pre-determined rolling pivoting path of the support plate.

BRIEF DESCRIPTION OF THE DRAWINGS

The invention will be better understood with reference to the following description and to the annexed drawings that form an integral part thereof.

DETAILED DESCRIPTION OF PREFERRED EMBODIMENTS

Figure 1:
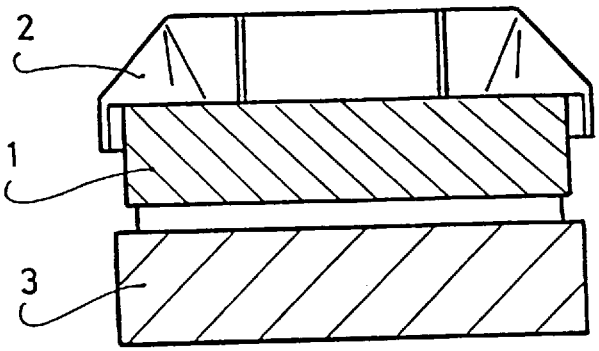
Fig: 1 PRIOR ART
FIGS. 1 and 2 represent front, sectional views of the front end of a boot pinched between the jaw of the binding element and the support plate, and illustrate prior art.

FIG. 1 represents front end 1 of a sole of a boot that is pinched between jaw 2 of a binding element and a support plate 3 upon which it rests. The binding element that bears jaw 2 is equipped with a compensation mechanism for backward falls, i.e., an upward vertical bias exerted on the jaw reduces the return force that must be overcome to cause the lateral opening of the jaw until the boot is released. Such compensation mechanisms are known, and some will be described in greater detail with the various embodiments selected to illustrate the invention.

Figure 2:
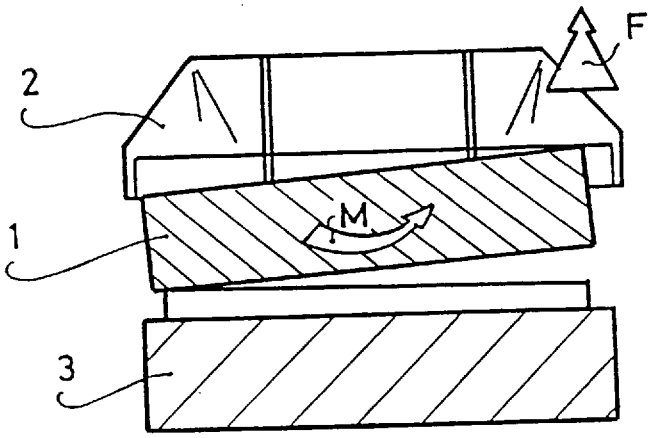
Fig: 2 PRIOR ART

The support plate 3 of FIG. 2 is traditional, i.e., it is immobile or it can be moved vertically downwardly in response to the downwardly oriented biases of the boot.

FIG. 2 shows the sole of boot 1 put in motion by a twisting movement due to the effect, for example, of a moment about a longitudinal axis, and that has been illustrated by the reference "M".

As a result of this moment, the boot tilts or pivots while taking support by one of its lateral edges on the support plate, and by vertically biasing the jaw upwardly with its other lateral edge. The reference "F" illustrates the vertical bias that the boot exerts on the jaw. It is this force F that activates the compensation mechanism and causes a reduction of the lateral retention force of the jaw.

Figure 3:
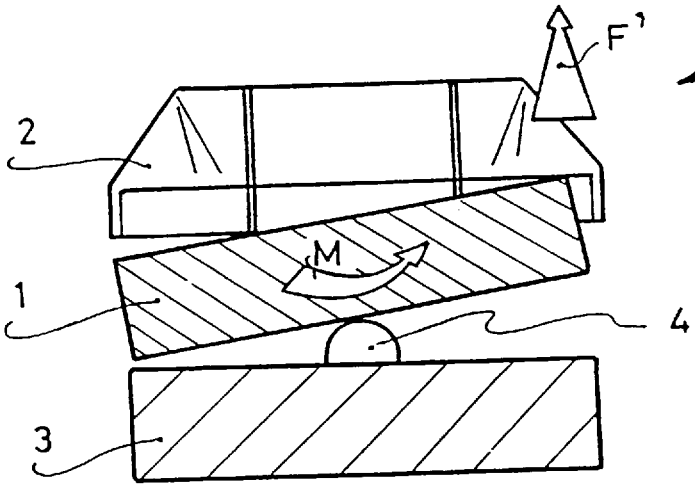
FIG. 3 is a view similar to FIG. 2 and generally illustrates the invention.

FIG. 3 illustrates the present invention. The sole of the boot no longer rests on a support plate but on a support element 4 that forms, for the sole of the boot, a downward vertical retention, as well as a central and longitudinal pivoting axis, located towards the middle of the width of the sole. FIG. 3 represents such support element in the form of a flange. This is not limiting, and as will be seen later, the support element can also be constituted by a support plate journaled about a longitudinal axis, or by any other means forming a vertical support for the sole and a lateral pivoting axis.

With reference to FIG. 3, a moment M having the same axis and same amplitude as the preceding one, causes the boot to tilt or pivot about support element 4. The rising edge of the sole this time induces a vertical force F' on the jaw, such force activating the rear compensation mechanism. Force F' is greater than F, in light of the fact that the boot pivots about support element 4, and no longer about its other lateral edge. F' is about twice F.

A more intense bias force activates the compensation circuit for a backward fall. In addition, such force further opens the jaw along a vertical direction.

Thus, the compensation resulting from the twisting of the boot is more efficient, and the pinching of the boot in the binding element is less pronounced than in the case of FIG. 2. Due to this fact, the lateral release of the boot is easier.

It is believed that in certain so-called pre-torsion fall configurations, leg and knee protection is thus improved.

FIGS. 4 through 7 are related to a first embodiment of the invention.

Binding element 5 represented in these drawings has a body 6 connected to a base 7 that is connected to the ski by any appropriate means, and for example, by screws.

Body 6 bears a retention jaw 8 for the front end of the boot. Jaw 8 comprises two lateral retention wings 9 and 10, respectively journaled to body 6 about axes 11 and 12. Jaw 8 also comprises a sole-tightener for vertical retention of the boot. Here, the sole-tightener is made up of two portions 13*a* and 13*b*, respectively joined to wings 9 and 10. only portion 13*b* is visible in FIG. 4.

Wings 9 and 10 are movable in response to the biases of the boot, against the return force exerted on them by a spring 15.

Spring 15 is housed in the body, in a housing 17. It activates a tie rod 16 also housed and guided in the body for a longitudinal translational movement. At the rear, the tie rod has a head 18, and at the front, a stopper 19 screwed onto the end of the tie rod, and guided in housing 17. Stopper 19 enables the pre-stress of the spring to be adjusted. The spring is in support towards the rear against the wall of the body, which is crossed by the tie rod, and which, besides, guides such tie rod. Towards the rear, the spring is retained by stopper 19, and the stopper can slide freely inside housing 17.

Beyond their respective journal axes with respect to the body, each of wings 9 and 10 has a small arm 9*a*, 10*a* that is engaged with the head of the tie rod such that the opening of a wing causes the rearward translation of the tie rod and the compression spring.

Body 6 is connected to base 7 by a transverse journal 22 located in the front portion of the body. As has been represented, at the front, the base has two lugs 20 and 21 between which the front portion of the body is engaged. The body is connected to such lugs by journal means, for example rivets, axle portions or any other appropriate means.

Towards the rear, a journaled connection rod 24 connects the base to head 18 of the tie rod. The connection rod is connected to the base, for example, by a journal axis 27, and to the head of the tie rod in the same way. At rest, the connection rod is oriented from the bottom to the top, and from the rear to the front, such that a pivoting of the body about axis 22 causes a rotation of the connection rod about its journal at the base, which in turn causes a rearward translation of tie rod 16. This translation disengages the head of the tie rod from the small arms of the wings, and proportionately relieves the wings at opening.

Figure 6:
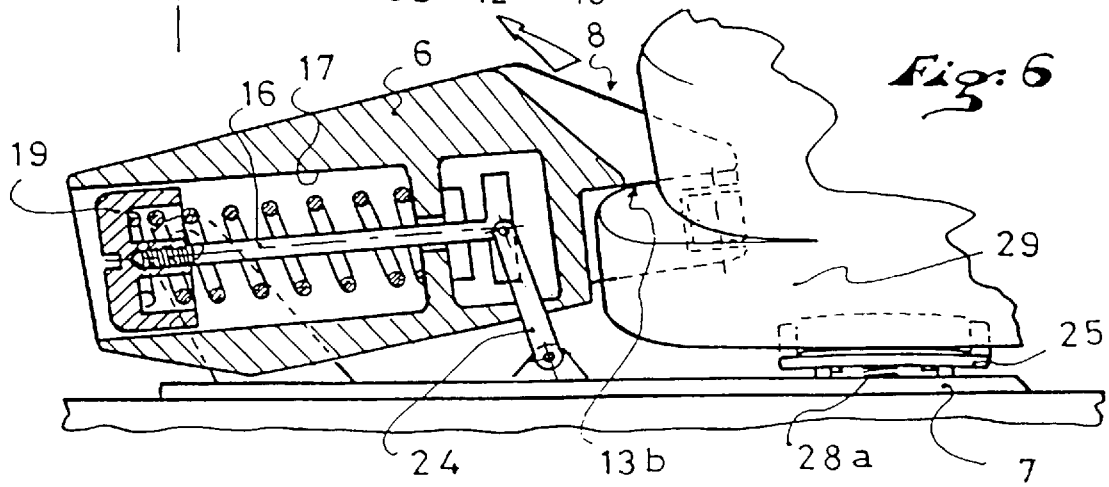
FIG. 6 illustrates the operating method of the binding element of FIG. 4.
Figure 7:
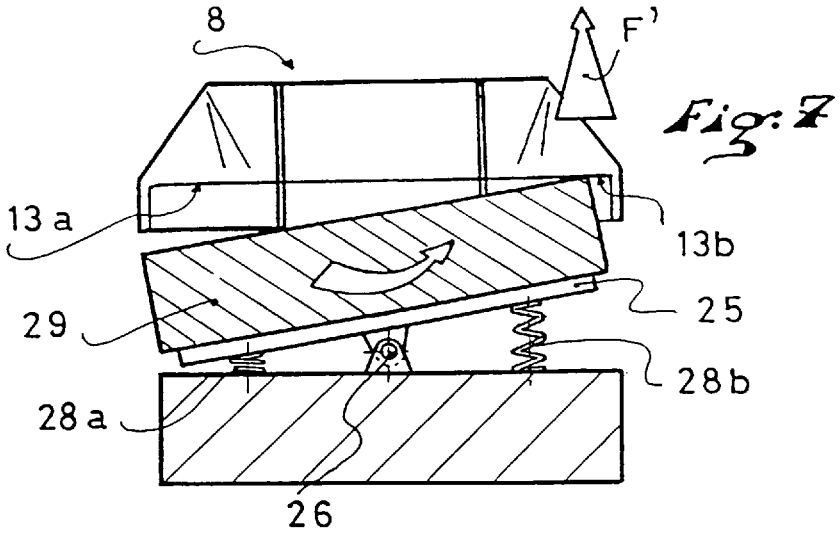
FIG. 7 illustrates the activation method of the boot on the binding element of FIG. 4.

As is illustrated in FIG. 6, a vertical upward bias exerted on the sole-tightener, following, for example, a backward fall by the skier, is translated by an elevation of the jaw, a rotation of connection rod 24, and a translation of the tie rod. This constitutes the compensation circuit for the backward fall.

According to the invention, the boot is in rearward support on a support element constituted by a support plate 25, that is movable over a rolling movement. As has been represented in the drawings, for example, towards the center of the width of the support plate, base 7 has two projecting stops that are aligned along a longitudinal axis. These stops bear an axis 26 oriented longitudinally, with respect to which support plate 25 is journaled. Support plate 25 can oscillate on both sides of a horizontal position about such axis 26 in response to the twisting or rolling biases of the boot. Finally, the support plate is maintained in its resting position by two lateral springs, or by elastically deformable blocks, which have shock absorption characteristics if so required. Such return and shock absorption elements have been represented by references 28*a* and 28*b*.

Figure 4:
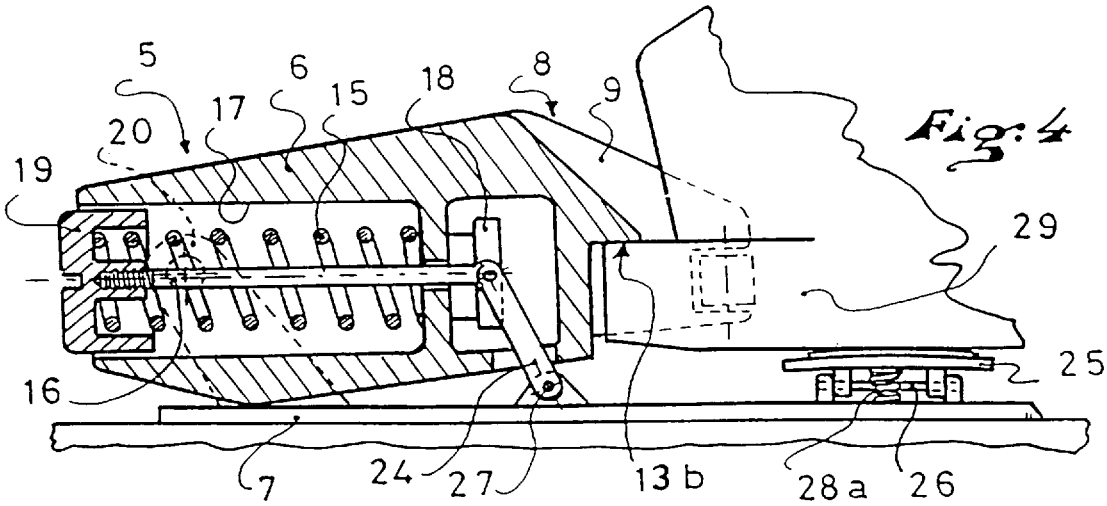
FIG. 4 is a partial sectional side view of a binding element implementing the overall principle of the invention.
Figure 5:
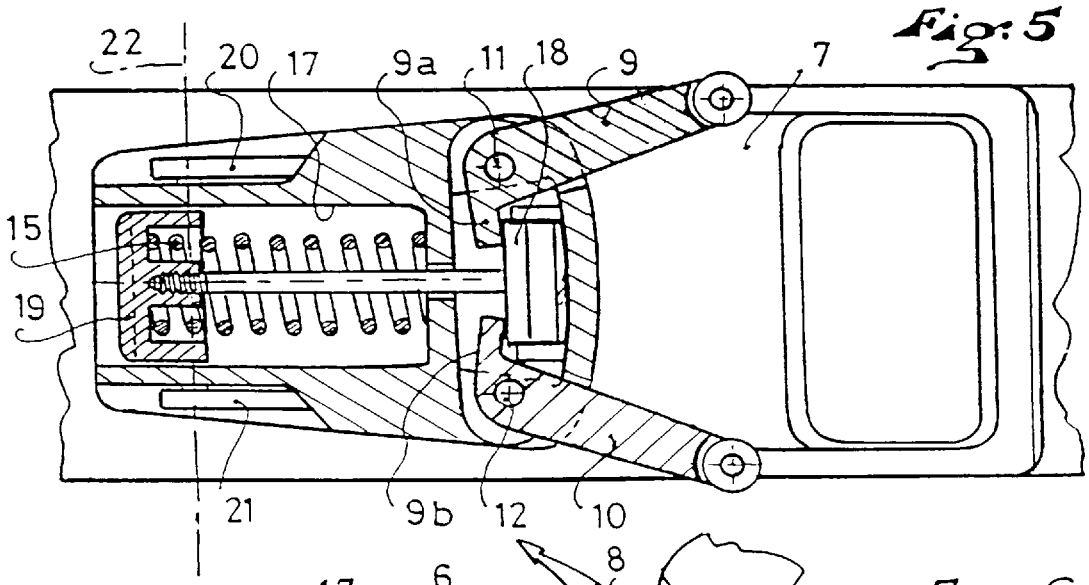
FIG. 5 is a partial sectional top view of the binding element of FIG. 4.

FIG. 4 represents the front 29 of a ski boot engaged in binding element 5. The sole of the boot is engaged between support plate 26 on which it rests and sole-tightener 13. It can be noted here that the thickness of the sole is standardized, and that as a general rule, the binding elements are designed in accordance with existing norms, so that the relative height of the sole-tightener with respect to the support plate corresponds substantially to the height of a standardized sole. In addition, an automatic or manual adjustment of such height is usually provided.

Binding element 5 functions as follows. In case of a backward fall, the sole of the boot biases sole-tightener 13 upwardly, and this activates the compensation circuit and reduces the lateral force that the boot must overcome in order to be released laterally. In case of a frontward fall, causing the boot to get twisted, as has been represented in FIG. 7, the boot drives support plate 25 to tilt. Due to this, a lateral edge of the boot rises and vertically biases that portion of the sole-tightener that retains it with a force F'. It has been seen previously that the vertical force exerted on the sole-tightener is amplified by the fact that the sole of the boot is in support against a central element and can pivot in a rolling motion with respect to such element. Force F' activates the compensation circuit of the boot element for a backward fall, and forces jaw 8 to rise. The return force that the boot must overcome to be released laterally is weaker in case the boot gets twisted, due to the fact that such compensation circuit get activated.

FIGS. 8 through 13 illustrate an embodiment variation of the invention. According to this variation, the compensation means, called second means, connect the support plate to the return spring, such that the rolling pivoting of the support plate generates a compensation on the return spring, which gets added to the compensation originating from the elevation of the jaw.

Figure 8:
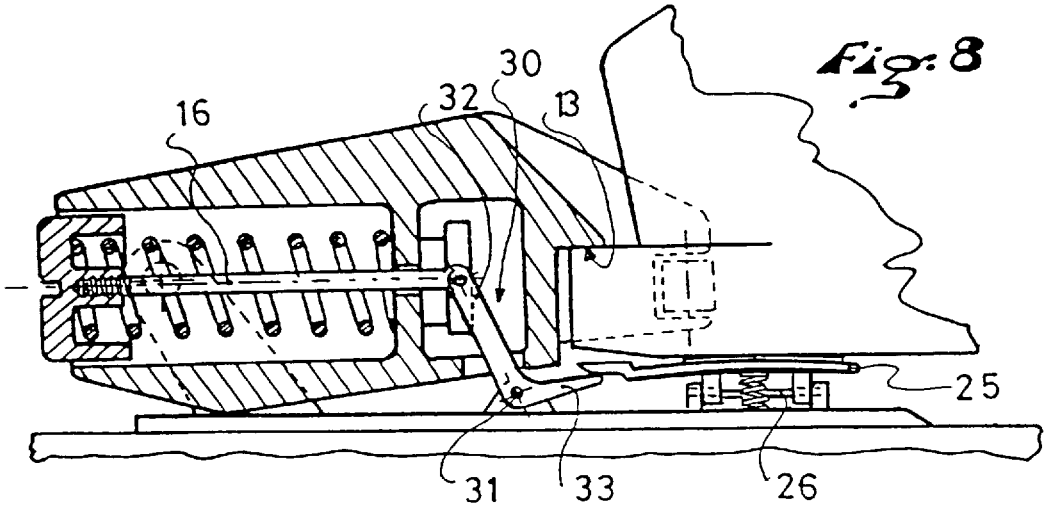
FIG. 8 represents a binding element in a side view and in a partial section according to another embodiment of the invention.
Figure 9:
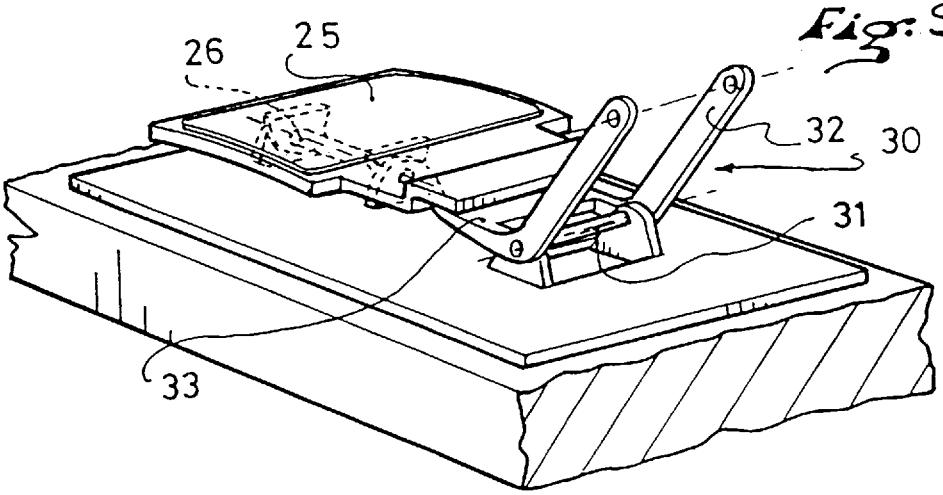
FIG. 9 is a partial perspective view of the binding element of FIG. 8 at the level of the support plate.
Figure 10:
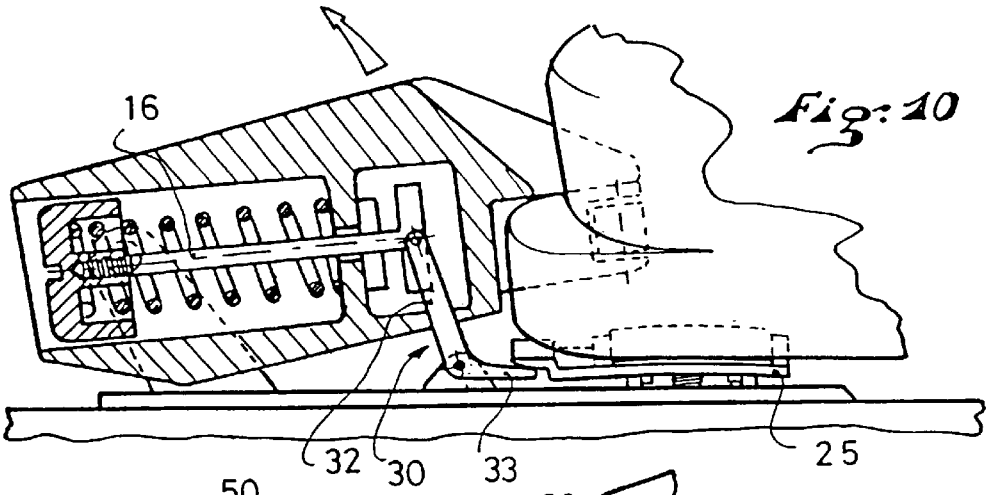
FIG. 10 illustrates the operating method of the binding element of FIG. 8.
Figure 11:
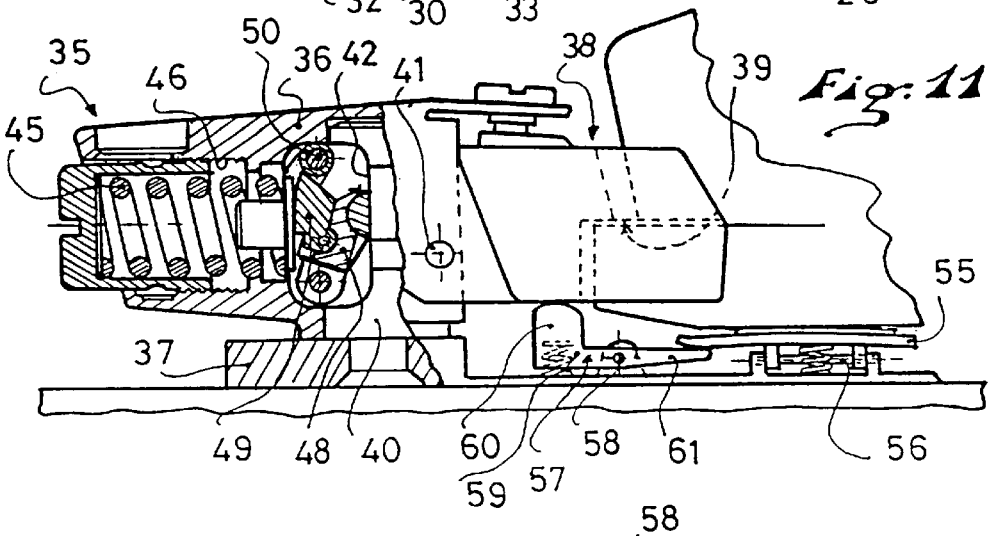
FIG. 11 represents a binding element in a side, partial sectional view, as per an embodiment variation of the invention.
Figure 12:
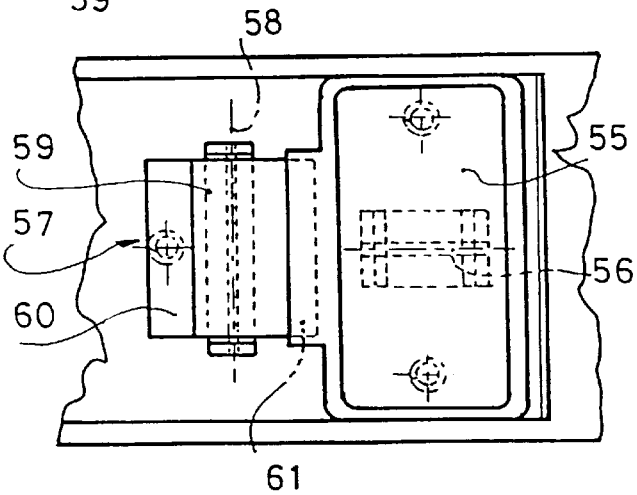
FIG. 12 is a top view of the binding element of FIG. 11 at the level of the support plate.
Figure 13:
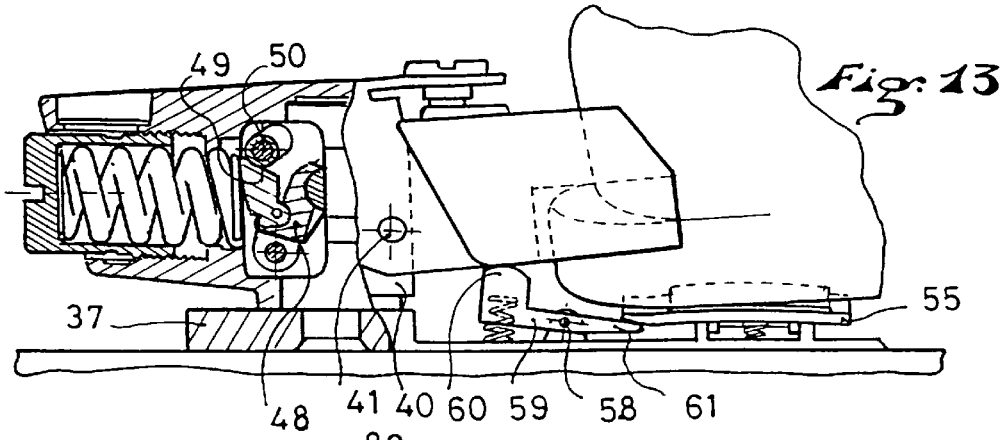
FIG. 13 illustrates the functioning of the binding element of FIG. 11.

FIGS. 8 through 10 are related to a first embodiment, and FIGS. 11 through 13 to a second embodiment.

The binding element represented in FIGS. 8 through 10 is identical for the main part to the one in FIGS. 4 through 7, and the same references will be used to designate the same elements.

The main difference arises from the fact that connection rod 24 that connected the base to the head of the tie rod is replaced here by a pivoting element 30 having two arms. The pivoting element is journaled about an axis 31 fixedly connected to the base. It has a first arm 32 that fulfills the same function as that of aforementioned tie rod 24.

Towards the rear, the pivoting element has an approximately horizontal second arm 33. Arm 33 is relatively wide and is engaged beneath the front edge of support plate 25. In the horizontal position of support plate 25, arm 33 has two contact zones with plate 25, such zones being located on either side of journal axis 26 of the plate. Thus any rolling movement of the support plate is translated by a rotation of the pivoting element in the direction of a rearward translation of tie rod 16.

As such, the rolling pivoting of support plate 25 induces an effect that gets added on to the effect produced by the elevation of the jaw. In the present case, it is pivoting element 30 that acts as the adder. The effect produced by the rolling pivoting of the support plate gets added to the effect produced by the elevation of the jaw, and generates a compensation that reduces the force that is required to laterally open one or the other of the wings. The boot itself distributes its twisting effect on plate 25 and sole-tightener 13. Indeed, it can become displaced vertically and freely, except for the friction, between these two elements.

It must be noted that the pivoting element constitutes a reversible connection, because the rolling pivoting of support plate 25 causes the elevation of jaw 8, independently of the vertical bias that is exerted on the jaw.

It has been noted that support plate 25 reacted not only to a twisting of the boot, but also to a pre-torsion fall without twisting. In this type of fall, it has indeed been noted that the maximum pressure of the boot on its support plate occurs after the boot starts to become displaced laterally. The resultant is thus off-set with respect to journal axis 26 of plate 25 and causes a motor effect on the rolling pivoting of the support plate.

FIGS. 11 through 13 represent an embodiment variation. FIG. 11 represents a binding element 35 that is already known for the most part. This element comprises a body 36 borne by a base 37. The base has a vertical pivot 40 about which body 36 is pivotally mounted. The body bears a retention jaw 38.

The jaw here is integral and comprises two portions forming the lateral retention wings and an upper portion forming a sole-tightener 39 for vertical retention.

The jaw and the body are affixed for any lateral pivoting movement about pivot 40. However, the jaw can pivot vertically with respect to the body about an axis 41, located in its lower portion.

Towards the front, pivot 40 has a flattened surface 42 against which a spring 45 takes support. Spring 45 is housed in an opening 46 of the body, and its other end takes support against a stopper screwed in the front portion of the body. In a pure lateral movement, the flattened surface causes the compression of the spring and the elastic return of the body and of the jaw into a centered position.

Spring 45 takes support against flattened surface 42 by means of transmission connection rods 48 and 49. Jaw 38 takes support against connection rod 49 by a transverse pin 50 located in its upper portion, such that an upward pivoting of the jaw pushes connection rod 49 back towards the front, against the return force of spring 45, which reduces the force that the spring exerts on flattened surface 42 of pivot 41, and thus reduces the resistance that the boot must overcome to laterally drive the jaw and if necessary, to be released. This constitutes the compensation means for a backward fall.

The binding element of FIG. 11 has, in addition, a support plate 55. Support plate 55 is journaled about a longitudinal axis 56 located towards the center of the width of the ski. The vertical distance between support plate 25 and sole-tightener 39 corresponds to the thickness of a boot sole.

A pivoting element 57 is located between support plate 55 and jaw 38. The pivoting element is journaled about a transverse axis 58 borne by base 37. Towards the front, the pivoting element has an arm 59 that is engaged beneath jaw 38. In the embodiment illustrated, the arm ends in a pad 60 that is in support against the lower surface of the jaw. Towards the rear, pivoting element 57 has an arm 61 that is relatively wide and that is engaged beneath support plate 55, in such a way that a rolling movement of the support plate about axis 56 causes a pivoting of pivoting element 57 about its journal axis 58. The pivoting element in turn forces the jaw to rise about its axis 41, which activates the compensation mechanism for a backward fall. This is illustrated in FIG. 13.

As such this mechanism gets activated both in the case of a backward fall as well as in the case of a fall causing the boot to become twisted in its binding element. The jaw is the member towards which these various biases converge, and the boot itself distributes the effect of its twisting between sole-tightener 39 and plate 55.

Figure 14:
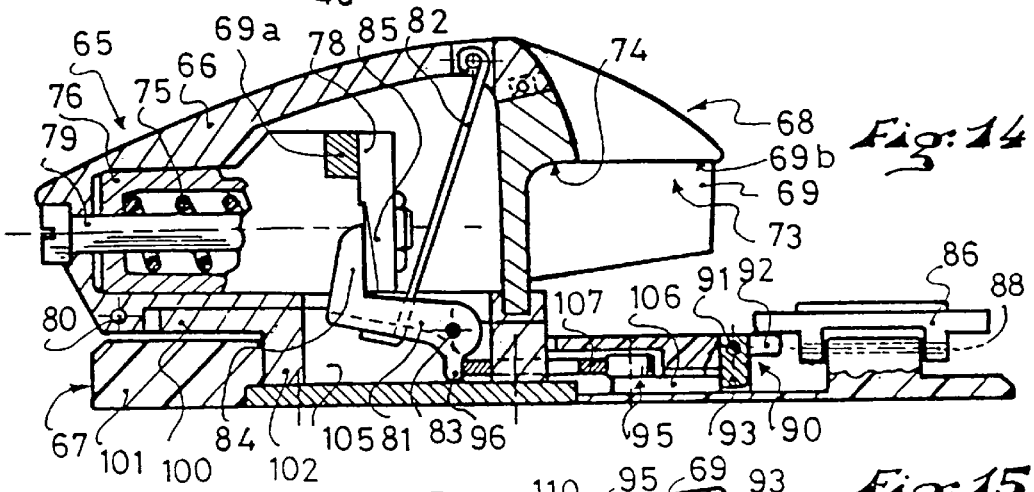
FIG. 14 represents, in a side partial sectional view, a binding element according to another embodiment of the invention.
Figure 15:
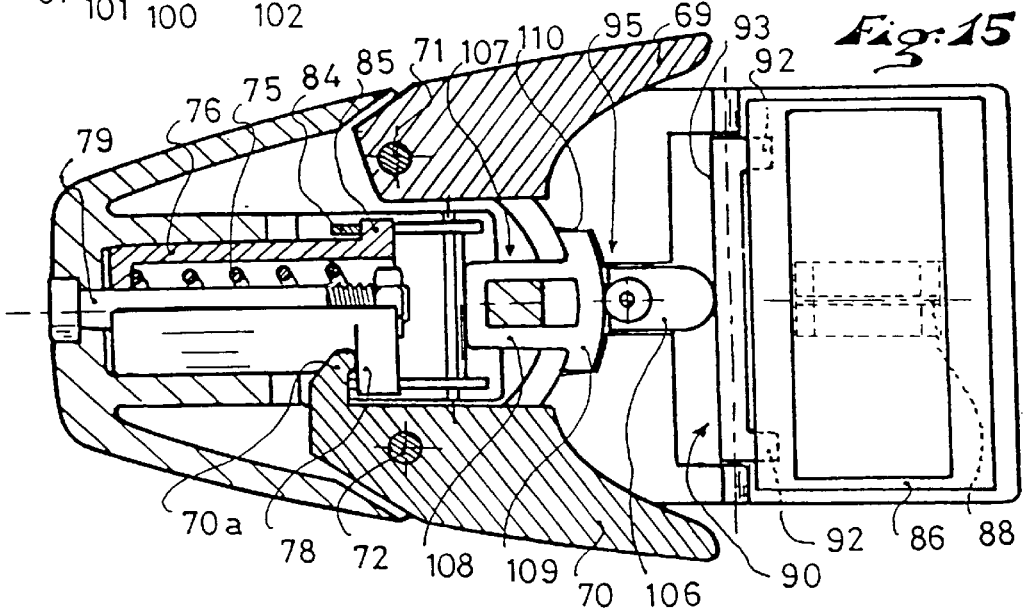
FIG. 15 is a top sectional view of the binding element of FIG. 14.
Figure 16:
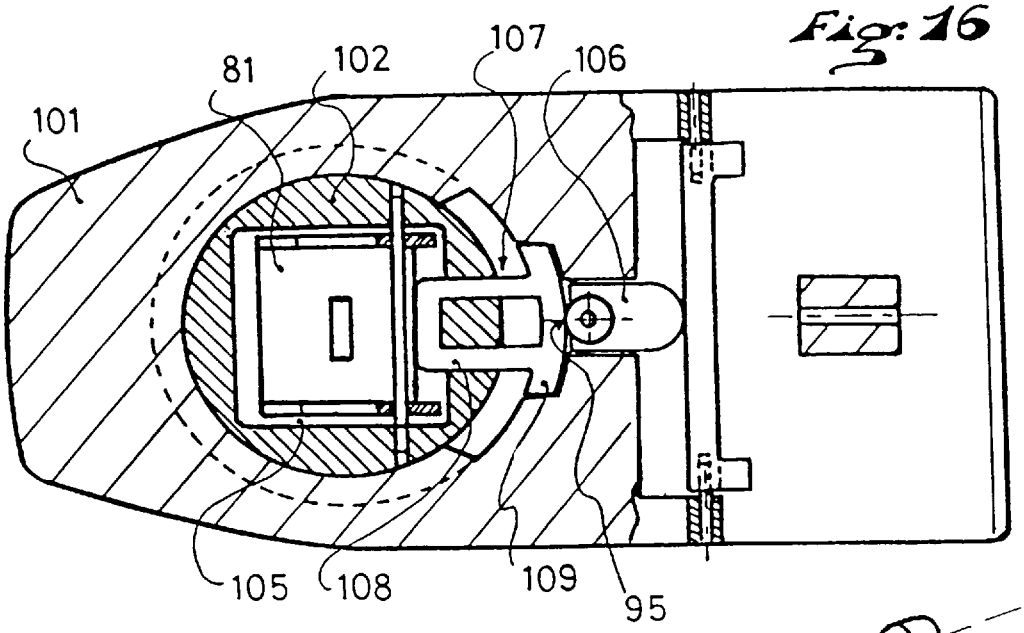
FIG. 16 is a top sectional view at a lower level.
Figure 17:
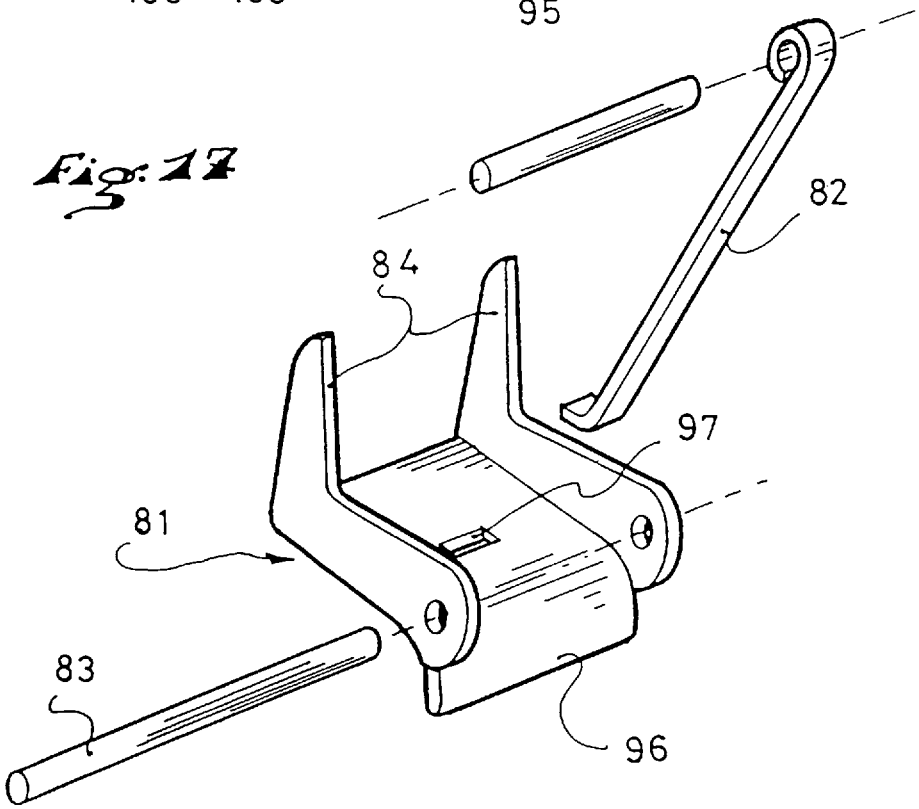
FIG. 17 is a perspective view of the pivoting element of the binding element of FIG. 14.

FIGS. 14 through 20 illustrate another embodiment of the invention. FIG. 14 represents a binding element 65 that overall is of the same type as the one represented in FIG. 4.

It has a body 66 mounted on a base 67 that is adapted to be affixed to the ski, and that will be described in greater detail later.

The body bears a jaw 68 that has two independent wings 69 and 70, respectively journaled about a vertical axis 71, 72. The jaw also comprises a vertical retention sole-tightener 73. The sole-tightener comprises three portions, two lateral portions **69*b* and 70*b* each respectively joined to each of wings 69, 70, and a central portion 74 affixed to body 66**.

Beyond their journal axis 71, 72, the wings have a small arm **69*a*, 70*a* that activates a piston 76 guided in a housing 77, and movable in translation against the return force of a compression spring 75. The arms 69*a* and 70*a* take support against a shoulder 78 that the piston has in its rear portion. As can be seen from FIGS. 14 and 15, the piston is hollowed, spring 75 is housed in the recess of the piston, and a rod 79 whose head is retained by the body crosses the piston and the spring from one side to the other, and retains the rear end of the piston by a nut. Thus, the opening of one of the wings induces a translation of piston 76 in its housing 77**, and an additional compression of the spring that resists this movement.

Body 66 is connected to base 67 by means of an axis 80 borne by the base towards the front, and oriented transversely. Axis 80 enables an elevation of the body in response to an upward vertical bias exerted on sole-tightener 73.

This movement is transmitted to piston 76 by a pivoting element 81 and a connection rod 82. Pivoting element 81 is journaled about an axis 83 borne by base 67 at the rear of axis 80 and oriented along a transverse direction. As can be seen from FIG. 17, towards the top the pivoting element has two parallel arms 84 whose upper portion is in support against a shoulder 85 of piston 76, located in the vicinity of shoulder 78 which takes up the biases from wings 69 and 70.

Connection rod 82, as for it, connects the upper and rear portion of body 66 to arm 84 of pivoting element 82, between journal axis 83 and shoulder 85, in such a way that an upward movement of the body drives pivoting element 82 in a direction that causes piston 76 to withdraw, thus inducing an additional compression of spring 75. The force to be exerted to open the wings until the release of the boot is reduced. This constitutes a compensation for a backward fall.

Binding element 65 has, in addition, a support plate 86 on which the front of the sole of the boot rests. As described in the previous examples, support plate 86 is rotationally movable about a horizontal axis 88 oriented along a longitudinal direction and located towards the center of the width of the plate. Axis 88 is borne, for example, by the rear portion of base 67.

The vertical distance between support plate 86 and sole-tightener 73 is close to the thickness of a standardized sole, as is habitual.

The rolling movement of plate 86 is sensed by pivoting element 90 journaled about a horizontal and transverse axis 91 located in front of plate 86. Towards the rear, pivoting element 90 has two tabs 92 respectively engaged beneath support plate 86 towards its lateral edges. Below axis 91, the pivoting element has an arm with a support surface 93 oriented downwardly.

By virtue of its support surface 93, the pivoting element frontwardly activates a thrustor 95 guided by base 67 along a longitudinal direction. Towards the front, thrustor 95 is in contact with previous pivoting element 81, by an arm 96 located towards the bottom with respect to its journal axis 83. In this way, a rolling pivoting of support plate 86 is transmitted to pivoting element 81 and causes a rearward translation of piston 76, i.e., in the same direction as caused by the opening of one of the wings or by the elevation of the body. All these biases get added at the level of piston 76.

The connection between pivoting element 81 and connection rod 82 is a single acting connection. As can be seen more clearly from FIG. 17, the lower portion of connection rod 82 is folded up towards the front and is engaged in an opening 97 of the main arm of the pivoting element. Thus, an upward translation of connection rod 82 causes the rotation of pivoting element 81, but this is not reversible, i.e., a rotation of pivoting element 81, for example following a rolling pivoting of support plate 86 does not force either connection rod 82 or body 66 to rise.

Naturally, this is non-limiting, and the connection between the connection rod and the pivoting element could be reversible. In this case, the connection could be obtained by a journal axis about an axis or any other appropriate means.

The binding element that is represented in FIGS. 14 through 20 has, in addition, a second boot release circuit. This circuit functions by disengagement or unlatching between a movable element, for example the jaw, body or base, and the element that bears it or which it is mounted, respectively, the body, base, or a base plate on which the base is mounted. The disengagement is activated by a latch whose displacement is controlled by the rolling movement of the support plate, and occurs after a pre-determined rolling path on one or the other side of its resting position.

In the embodiment illustrated, base 67 is made up of two parts, an upper plate 100 and a lower base plate 101 adapted to be affixed to the ski. Both these elements are mounted pivotally with respect to one another about a pivot 102 having a vertical axis. As can be seen from FIG. 14, pivot 102 is the lower portion of plate 100 and is retained in a cylindrical opening of base plate 101. Pivot 102 is hollowed in its central portion, and pivoting element 81 is partially housed in such recess 105. Journal axis 80 of the body, journal axis 83 of pivoting element 81 are borne by plate 100. Axis 88 of support plate 86 is borne by base plate 101.

The disengagement occurs between the plate and the base plate, i.e., the plate, the body and the jaw can pivot freely about pivot 102, beyond a pre-determined rolling path of support plate 86.

In the embodiment illustrated, the latch is constituted by a portion of thrustor 95 that connects the two pivoting elements 81 and 90. As can be seen, thrustor 95 is made up of two parts, one of them, 106, is in contact with pivoting element 90 and is guided with respect to base plate 101, the other 107, shaped like an anchor, is guided in plate 100 in the vicinity of pivot 102.

Anchor 107 comprises a body 108 that is in support against pivoting element 81, an in-curved arm 109 that is located outside pivot 102, and that is housed in a recess 110 of the base plate, having a complementary shape. Arm 109 acts as the latch in cooperation with recess 110. When the arm comes out of its recess, the plate is released with respect to the base plate, and a very weak bias is enough to make the jaw, body and plate pivot laterally, and thus, to release the boot. The rotation of the plate with respect to the base plate has an adequate amplitude to force the release of the boot.

The translation of the arm in its housing is controlled by the translation of thrustor 95, i.e., the rotation of pivoting element 90, which itself is induced by the rolling pivoting of support plate 86.

The functioning of binding element 65 in case the boot gets twisted is as follows.

Figure 18:
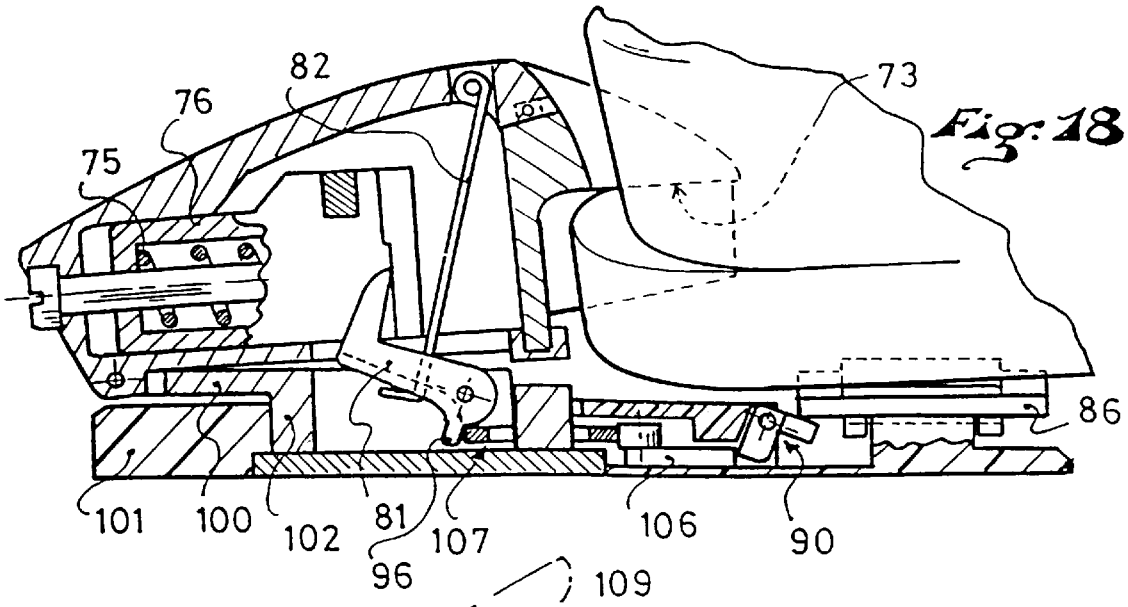
FIGS. 18 and 19 illustrate the operation method of the binding element of FIG. 14.

For a weak twisting bias of the boot, the rolling pivoting of the support plate pushes thrustor 95 towards the front, thus causing a rotation of pivoting element 81, and a translation of piston 75, thus causing the resistance force of the wings during opening to get reduced. The rolling pivoting of the support plate is accompanied by an upward vertical bias exerted by the boot on sole-tightener 73 of the binding element. Pivoting element 81 adds the biases to which it is subject and transmits them to piston 76. FIG. 18 is illustrative of this method of operation.

Figure 19:
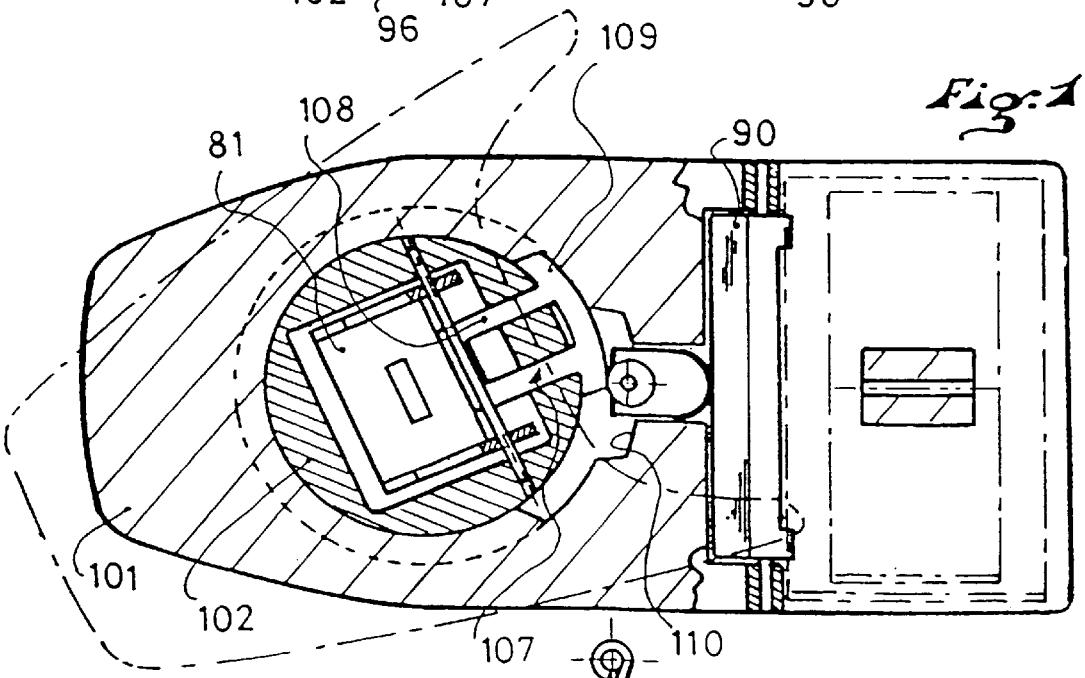

If the rolling movement crosses a pre-determined amplitude, arm 109 of anchor 107 comes out of its recess and disengages plate 100 with respect to base plate 101 until the boot gets released. FIG. 19 is illustrative of this method of operation.

At this stage, any appropriate means can be provided to return the plate to its nominal position, for example, an independent return spring connecting the plate and the base plate, or the external wall of arm 109 of the anchor can be given a ramp-like shape.

Figure 20:
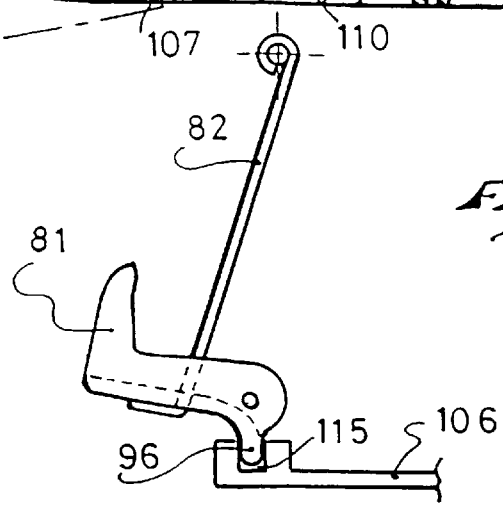
FIG. 20 illustrates an embodiment variation.

FIG. 20 illustrates an embodiment variation. As per this variation, the connection between pivoting element 81 and anchor 106 is reversible. For example, arm 96 of pivoting element 81 is engaged in a groove 115 present in the body of anchor 106. In this way, the disengagement of plate 100 is also produced in case of a backward fall causing the elevation of the body beyond a pre-determined amplitude. Indeed, connection rod 82 rotationally drives pivoting element 81, which in turn translationally drives anchor 106 towards the front.

Figure 21:
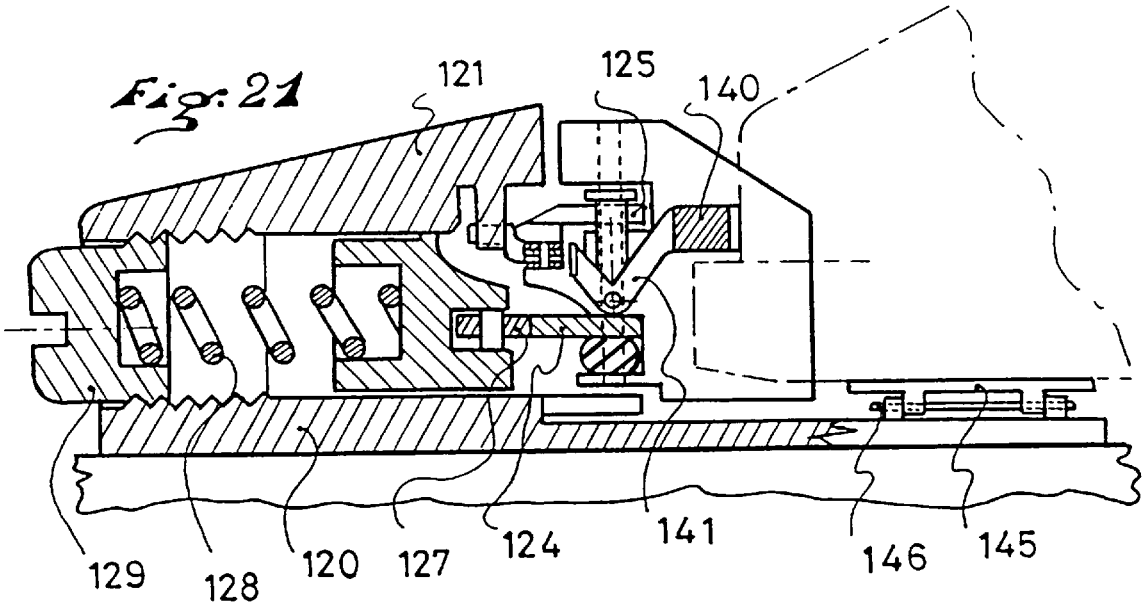
FIGS. 21 through 23 illustrate another embodiment of the invention.
Figure 22:
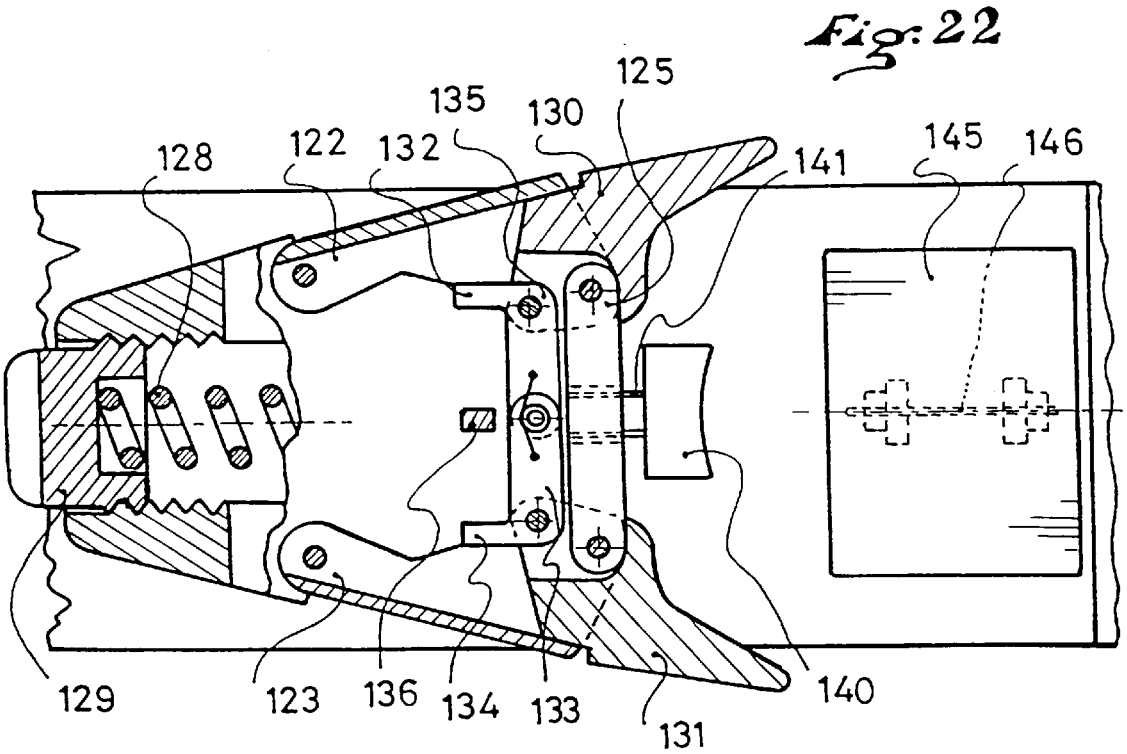
Figure 23:
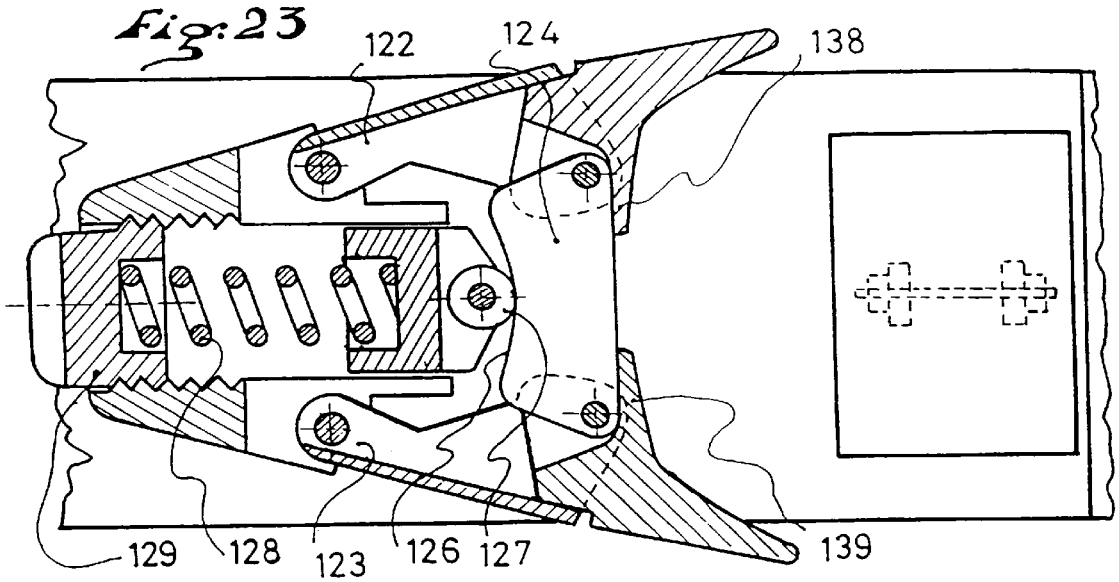

FIGS. 21 through 23 illustrate another embodiment of the invention. The binding element used to illustrate this embodiment has, in addition to the support element of the boot, a structure that is known for the most part in view of French Patent Publication No. 2,656,807.

This structure has a base 120 intended to be affixed to the ski, and overlaid by a body 121. Two arms 122 and 123 are journaled to the body, about substantially vertical axes. Towards the rear, the two arms are connected by two superposed cross-pieces 124 and 125. One of such cross-pieces, incidentally the lower cross-piece 124 bears, on its frontal surface, a ramp 126 that is in-curved from a top view, against which a roller 127 is compressed, said roller being pushed back by a spring 128 housed in the body. Besides, a threaded stopper 129 enables the initial compression of the spring to be adjusted.

A retention wing of boot 130 and 131 is journaled at the rear end of each arm about the axis that already connects the arm and the cross-pieces. The wings extend beyond such axis and are joined together by two levers 132 and 133 journaled in their central zone in the manner of a knuckle-joint. In the closed position of the knuckle joint, both wings are kept enclosed, substantially in the extension of arms 122 and 123 that bear them. Mainly, they are kept in position by a shoulder 138, 139 provided to cooperate with the lower cross-piece 124.

The levers 132 and 133 have two returns 134 and 135 oriented frontwardly, that can meet a central stop 136 in case of a lateral movement of arms 122 and 123.

The arms and the wings form, in conjunction with the body, the cross-pieces, and the two knuckle joint levers form two deformable trapezoids overlapping one another.

During a lateral bias of the boot, both trapezoids are driven laterally against the return force that spring 128 exerts on the lower cross-piece by roller 127 and ramp 126.

Beyond a certain pre-determined angular amplitude, one of returns 134 or 135 is retained by central stop 136, which causes the opening of the knuckle joint formed by the two levers 132 and 133. The wings can thus open, especially the wing that the boot has biased laterally. The boot is then released.

Towards the top, the boot is retained by a sole-tightener. Here, the sole-tightener is made up of two parts, respectively joined to each of the wings. Preferably, the surface of the wings that forms the sole-tightener is inclined so as to let the boot escape in case of a rearward bias.

In addition, a central sensor 140 is located between the two wings, substantially at the height of the sole-tightener. The sensor is adapted to get positioned slightly above the upper surface of the sole of the boot.

The sensor is the end of a pivoting lever 141 that is journaled about a horizontal and transverse axis borne by the connection structure between the arms and the wings. The front arm of lever 141 is located across from the journal of both levers 132 and 133 of the knuckle joint. Lever 141 is adapted to open the knuckle joint when sensor 140 is biased upwardly. As such, one can anticipate the opening of the wings when the boot biases the binding element with a component upwardly.

Towards the bottom, the boot rests on a support plate 145 that is journaled about a horizontal and transverse axis 146 borne by the rearward extension of base 120.

Plate 145 can oscillate in response to the biases of the boot on either side of a horizontal position. The distance between the upper surface of the support plate and the lower surface of sensor 140 is equal to the thickness of the sole of the boot, or slightly greater.

When the boot is put in motion by a rolling movement, it pivots laterally about axis 146. A portion of the sole of the boot rises and comes into contact with sensor 140. If the amplitude of the pivoting movement is enough, lever 141 forces the knuckle joint to open.

The sensitivity of the sensor is partially determined by its width. For example, this width is about a quarter or a third of the width of the sole of the boot.

The journal axis of the support plate is not necessarily concertized. This axis can also be imaginary.

Figure 24:
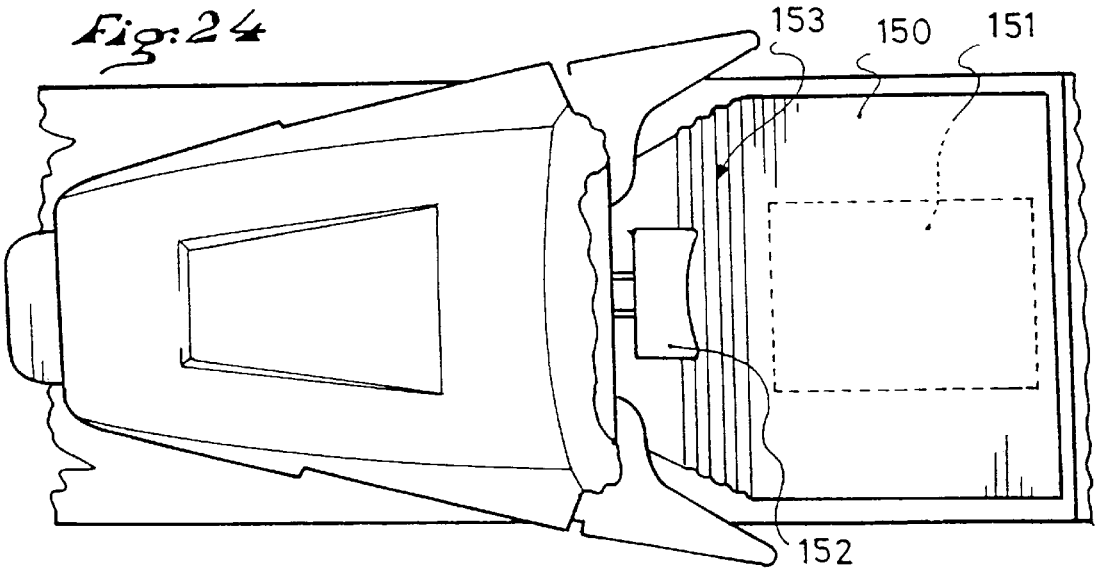
FIGS. 24 through 26 are related to an embodiment variation.
Figure 25:
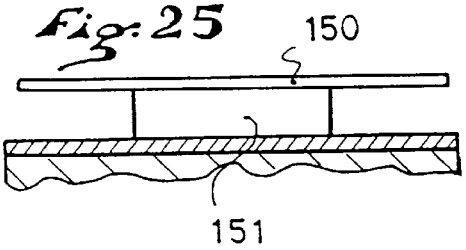

In order to illustrate this, FIG. 24 represents a binding element of the same type as in FIG. 21, except that support plate 150 on which the sole of the boot rests is connected to the jaw and is movable therewith. The support element become displaced laterally with the boot and the jaw of the binding.

Figure 26:
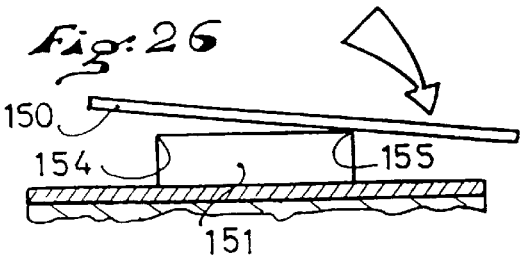

Support plate 150 rests on an immobile support 151 whose width is less than that of the plate. Support 151 laterally provides two longitudinal ridges 154, 155 about which the support plate can pivot or tilt in case of a rolling bias of the boot. As has been represented in FIG. 26, when the support plate is displaced laterally by a certain angle, one of the ridges, ridge 155, e.g., finds itself located in the median zone of the plate and provides an imaginary pivoting axis to the plate. In this position, one part of the boot is raised and activates sensor 152 similar to previous sensor 140. Indeed, the resting distance between the upper surface of the support plate and the sensor is equal or very slightly greater than the thickness of the sole of the boot.

To facilitate the pivoting, preferably, the support plate is connected to the jaw by a set of waves 153 that form a deformable connection zone. The stop can also be replaced by a set of ramps or other means of the same type.

Naturally, the present description is only provided as an example, and other variations of the invention could be envisioned without leaving the scope thereof.

Especially, in the aforementioned embodiments, the support plate is connected to the compensation circuit for a backward fall at the level of the jaw itself or at the level of a pivoting element that connects the jaw to the return spring. It is understood that this is non-limiting, and that the support plate could be connected to any movable element of the backward fall compensation means, for example, the tie rod or the piston that connects the pivoting element or the jaw to the spring.

In addition, the reaction of the jaw to an upward vertical bias has been described in the form of an elevation of the jaw by rotation about a transverse axis. It is understood that this is non-limiting, and that the jaw, or if necessary, the sole-tightener could be put in motion by a pivoting movement about a longitudinal direction, in response to an upward, vertical bias.

The instant application is based upon French patent application No. 93.13677 of Nov. 10, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A binding assembly for retaining a boot on an alpine ski, the boot having a sole with an end portion, said binding comprising:

a base for attachment to a ski;

a body mounted on said base, a retention jaw borne by said body, said retention jaw comprising two lateral retention wings for laterally retaining the boot, each of said lateral retention wings being mounted at least for a respective horizontal component of movement during a boot release movement in response to a release force transmitted by the boot, and a sole-tightener having at least one portion for engagement with an upper surface of the end portion of the sole for vertical retention of the boot;

a spring housed in said body for elastically opposing movement of said lateral retention wings in response to said release force transmitted by the boot;

a compensation mechanism comprising means for reducing a retention force exerted by said jaw against the boot in response to an upward vertical component of force exerted by the end portion of said sole against said jaw;

a support plate for supporting at least the end of the sole of the boot in the vicinity of said jaw, said support plate having, in a rest position, an upper horizontal support surface located a predeterminate distance from said sole-tightener of said jaw, said predeterminate distance being substantially equal to a thickness of the sole of the boot; and an arrangement for defining a pivotal movement of said support plate about a substantially longitudinal fixed axis;

said compensation mechanism being responsive only to an upwardly directed force against said at least one portion of said sole tightener; and said compensation mechanism being operatively mechanically connected to said support plate only by means of said boot sole.

2. A binding assembly according to claim 1, wherein:

said arrangement for defining a pivotal movement of said support plate includes an axle about which said support plate is mounted for said pivotal movement.

3. A binding assembly according to claim 2, wherein:

said axle is located in a median plane of the ski binding.

4. A binding assembly according to claim 1, wherein:

said arrangement for defining a pivotal movement of said support plate includes a structure for ensuring said pivotal movement about an imaginary axis.

5. A binding assembly according to claim 4, wherein:

said axis is located in a median plane of the ski binding.

6. A binding assembly according to claim 4, wherein:

said structure conprises a support upon which said support plate is supported, said pivotal movement being defined about at least one edge of said support, said one edge extending substantially longitudinally.

7. A binding assembly according to claim 1, wherein:

said compensation circuit comprises means for reducing said retention force in response to a backward fall of a skier having a boot secured in said retention jaw.

8. A binding assembly according to claim 1, wherein:

said body is mounted for upward movement of said retention jaw; and said compensation circuit comprises an operative linkage between said support plate and said retention jaw for causing said retention jaw to move upwardly.

9. A binding assembly according to claim 8, wherein:

said linkage is constituted by a sole of said boot.

10. A binding assembly according to claim 1, wherein:

said an arrangement for defining a pivotal movement of said support plate about a substantially longitudinal fixed axis is affixed to said base, whereby both of said support plate and retention device for the end of the boot are supported on said base.

11. A binding assembly according to claim 1, wherein:

said arrangement for defining a pivotal movement of said support plate includes a vertical support for said support plate vertically beneath said support plate.

12. A binding assembly according to claim 1, wherein:

said arrangement for defining a pivotal movement of said support plate only about a substantially longitudinal fixed axis.

13. A binding assembly for retaining a boot on an alpine ski, the boot having a sole with an end portion, said binding comprising:

a base for attachment to a ski;

a body mounted on said base;

a retention device for retaining the end portion of the sole of the boot against lateral movement and against vertical movement, said retention device comprising substantially laterally facing surfaces for engaging respective substantially laterally facing surfaces of the end portion of the sole of the boot and a downwardly facing surface for engaging a respective upwardly facing surface of the end portion of the sole of the boot, said retention device including a spring housed in said body for elastically opposing said lateral movement of the end portion of the sole of the boot;

a support plate for supporting at least the end portion of the sole of the boot in the vicinity of said retention device, said support plate having, in a rest position, an upper horizontal support surface located in a predeterminate distance from said downwardly facing surface of said retention device for securing the end portion of the sole of the boot between said upper horizontal support surface of said support plate and said downwardly facing surface of said retention device;

an arrangement for defining a pivotal movement of said support plate about a substantially longitudinal axis adapted to be fixed with respect to the ski; and a compensation mechanism comprising an assembly of parts operably connected to said spring, said assembly of parts functioning in response to an upward vertical component of force exerted by said upwardly facing surface of the end portion of the sole of the boot against said downwardly facing surface of said retention device to reduce a lateral retention force exerted by said retention device against the boot for facilitating lateral release of the boot;

said compensation mechanism being responsive only to an upwardly directed force against said retention device; and said compensation mechanism being operatively mechanically connected to said support plate only by means of said boot sole.

14. A binding assembly according to claim 13, wherein:

said longitudinal fixed axis is longitudinally centrally located with respect to said support plate.

15. A binding assembly according to claim 13, wherein:

said arrangement for defining a pivotal movement of said support plate comprises means for maintaining a middle portion of said support plate against downward movement.

16. A binding assembly according to claim 13, wherein:

said an arrangement for defining a pivotal movement of said support plate about a substantially longitudinal fixed axis is affixed to said base, whereby both of said support plate and retention device for the end of the boot are supported on said base.

17. A binding assembly according to claim 13, wherein:

said arrangement for defining a pivotal movement of said support plate includes a vertical support for said support plate vertically beneath said support plate.

18. A binding assembly according to claim 13, wherein:

said arrangement for defining a pivotal movement of said support plate only about a substantially longitudinal fixed axis.

* * * * *